United States Patent [19]

Ebneth et al.

[11] Patent Number: 4,572,960

[45] Date of Patent: Feb. 25, 1986

[54] USE OF METALLIZED KNITTED NET FABRICS FOR PROTECTION AGAINST MICROWAVE RADIATION

[75] Inventors: Harold Ebneth, Leverkusen; Hans G. Fitzky, Odenthal; Gerhard D. Wolf, Dormagen; Henning Giesecke, Cologne, all of Fed. Rep. of Germany

[73] Assignee: Bayer Aktiengesellschaft, Leverkusen, Fed. Rep. of Germany

[21] Appl. No.: 438,190

[22] Filed: Nov. 1, 1982

[30] Foreign Application Priority Data

Nov. 21, 1981 [DE] Fed. Rep. of Germany ..... 3146233

[51] Int. Cl.[4] ..... G21F 3/02

[52] U.S. Cl. ..... 250/516.1; 343/18 A

[58] Field of Search ..... 343/909, 18 A, 897; 250/516.1

[56] References Cited

U.S. PATENT DOCUMENTS

| | | | |
|---|---|---|---|
| 3,047,860 | 7/1962 | Swallow et al. | 343/897 |
| 3,164,840 | 1/1965 | Reynolds | 250/516.1 |
| 3,969,731 | 7/1976 | Jenkins et al. | 343/897 |
| 4,064,305 | 12/1977 | Wallin | 343/18 A |
| 4,092,453 | 5/1978 | Jonda | 343/897 |
| 4,134,119 | 1/1979 | Sandoz et al. | 343/703 |
| 4,320,403 | 3/1982 | Ebneth et al. | 343/897 |

*Primary Examiner*—Eli Lieberman

*Attorney, Agent, or Firm*—Sprung Horn Kramer & Woods

[57] ABSTRACT

Metallized, particularly nickel-coated, knitted net fabrics are suitable for protecting the eyes against microwave radiation with very little adverse effect upon the field of vision, particularly when the mesh width of the knitted net fabrics amounts to $<0.25\ \lambda$, preferably $<0.1\ \lambda$, $\lambda$ being the wavelength of the radiation to be screened off at the upper frequency limit.

13 Claims, 2 Drawing Figures

USE OF METALLIZED KNITTED NET FABRICS FOR PROTECTION AGAINST MICROWAVE RADIATION

BACKGROUND OF THE INVENTION

In the vicinity of transmitting antennae, particularly directional antennas, which are fed with frequencies ranging from 100 MHz to 100 GHz, high power densities of the electromagnetic field, may occur according to the transmitting power. These power densities may endanger the health of human beings on thermal grounds. In the Federal Republic of Germany, the permitted limits to the power density of distant field radiation so far as human beings are concerned are laid down by DIN 57 848 (VDE 0848, Part 2, August 1979) in accordance with similar specifications in other countries. A power density of 10 mW/cm$^2$ for prolonged radiation is quoted in DIN 57 848 as the maximum value for the frequency range from 30 MHz to 30 GHz. A detailed substantiation of these anti-radiation provisions are presented by J. H. Bernhard in PTB-Mitt 90 (1980) 6, 416/433. In addition, in Paul Brodeur's book entitled "The Zapping of America", the risks to health of strong electromagnetic fields are discussed in detail. Protective suits are specified for people working in the vicinity of strong high-frequency electromagnetic fields having power densities above 10 mW/cm$^2$. US Military Specification MIL-C-82296A is concerned with the quality of protective suits which allow people to remain in the power density range up to 200 mW/cm$^2$ in the frequency range from 200 MHz to 10 GHz.

With such high power densities, particular problems are involved above all in the protection of low-circulation organs where overheating readily occurs. On page 62 of the above-mentioned book, it is stated, for example, that damage to the eyes has been caused by so-called cataract formation which may lead to blindness.

Protective suits complying with US Military Specification MIL-C-82296A consist of tightly woven, silver-coated textiles. Nothing is said about suitable eye protection which allows the passage of visible light. The protective goggles of narrow-mesh wire netting which are known from medical diathermy interfere with the sight and only afford adequate protection on account of the diffraction of the microwaves at the edges of the shield. Goggles in which electrically conductive glass is used as the shielding material are attended by similar disadvantages. For example, the permeability to light for a surface resistance of 10 ohms still amounts to 60%. For a surface resistance of 1 ohm, which would be necessary for screening 30 to 40 db, permeability to light falls to less than 40% (C. Rint, Handbuch fur Hochfrequenz- und Elektrotechniker, 1978, Vol 2, page 493).

SUMMARY OF THE INVENTION

An object of the present invention was to fine materials with which it is possible to protect the body, especially the eyes, against microwave radiation with the least possible impairment of the field of vision.

It has surprisingly been found that, without losing the textile character thereof, metallised, particularly nickel-coated, knitted fabrics of filament yarns having a relatively large mesh width provide effective shielding against distant-field electromagnetic radiation and, in particular, against microwave radiation coupled with a very high light transmission level of more than 90 to 95%. Knitted net fabrics of this type may be used instead of protective goggles to protect the face and eyes. The metallised knitted net fabric is best used for sealing of the hood opening of the protective suit. In this connection, complete protection against radiation may be achieved by a broadly overlapping seam with the material of the protective suit.

The knitted net fabric is characterised by a mesh width of $<0.25\lambda$, preferably $<0.1\lambda$, $\lambda$ being the wavelength of the radiation to be screened off at the upper frequency limit.

The shielding effectiveness of a metallised knitted net fabric exceeds 20 db in the frequency range from 0.2 to 10 GHz and thus meets the requirements of MIL-C-82296A. The knitted net fabrics may be metallised in accordance with DE-PS Nos. 2,743,768 or 3,025,307. The high shielding values are achieved by good reflection of the radiation.

Improvements in the shielding effect of 2 to 3 db may be obtained by subsequently impregnating the knitted net fabric with a polyurethane material, particularly a conductive polyurethane material containing carbon black. The percentage of free openings in the knitted fabric is from 80 to 95%. Knitted net fabrics, particularly tulle fabrics and warp knitted fabrics, for example of polyamide or polyester filament yarns, are generally suitable for use as the textile fabric.

Textile fabrics characterised by a low inductive surface impedance component and high capacitive couplings at the intersections, for example bobinet tulle, are preferred. Suitable metals are nickel, gold, cobalt, coper and combinations thereof. Nickel is preferred. The metal deposited on the individual filament amounts to from 0.1 to 1.0 $\mu$m.

DETAILED DESCRIPTION OF THE INVENTION

Figure 1:
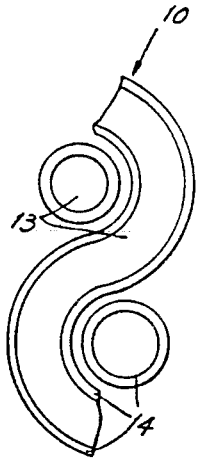
FIG. 1 is a schematic representative of two fibers of a metallized textile fabric for use in the present invention.
Figure 2:
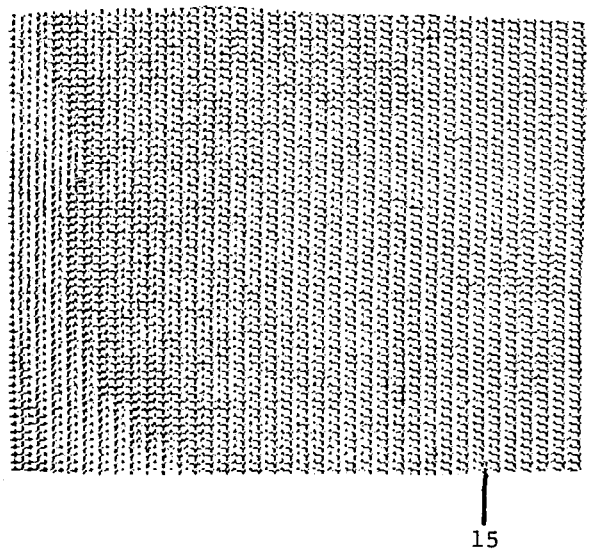
FIG. 2 is a schematic representative of a metallized textile fabric composed of the fibers shown in FIG. 1.

In FIG. 1, a metallized textile fabric 10 is depicted having fibers 13 with a metal coating 14 thereon. In FIG. 2, a fabric 15 composed of the fibers of FIG. 1 is depicted.

EXAMPLE

An antenna net measuring 43×43 cm, produced from polyester filament yarn on a warp knitting machine to the following testile specification: dtex 50f20, smooth, delustred; threading: guide bar I: 1 full—1 empty; guide bar II: 1 full—1 empty. Pattern: guide bar II $\mathbf{1}_{01}$ $\mathbf{3}_{43}$; guide bar I $\mathbf{3}_{43}$ $\mathbf{1}_{01}$, warp ratio: links 96, pins 48, was immersed for 60 seconds in a solution of 0.05 g of butadiene palladium dichloride in 1 liter of methylene chloride, dried at room temperature and nickel-coated for 30 minutes in an alkaline nickel coating bath. The nickel bath consisted of 30 g/l of nickel chloride, 3 g/l of dimethyl aminoborane and 10 g/l of citric acid and was adjusted with ammonia to pH 8.1. The surface began to darken after about 25 seconds. After 20 minutes, a firmly adhering, metallically bright nickel layer had been deposited on the antenna net. After this time, the textile material was covered with 16.8 g/m$^2$ of nickel, corresponding to 37.6%. The resistance per square meter was from 0.1 to 0.2 ohm.

Shielding effect of the nickel-coated knitted net fabric, values in db

| Frequency (GHz) | 1–1.5 | | 2.6–3.9 | | 9–10 | | 34–36 | |
|---|---|---|---|---|---|---|---|---|
| | T | R | T | R | T | R | T | R |
| | 42 | 0.1 | 40 | 0.1 | 31 | 0.1 | 21 | 0.3 |

T = Shielding effectiveness in db
R = reflection loss in db

We claim:

1. In a method of protecting the body, especially the eyes, against microwave radiation of a power density range up to 200 mW/cm$^2$ in the frequency range from 0.2 to 10 GHz comprising covering those parts of the body to be protected with a metallized textile fabric, wherein the improvement comprises said fabric including a metal layer deposited on individual filaments of the fabric, said fabric having a shielding effectiveness which exceeds 20 db and a light transmission of more than 90 to 95%, said fabric being impregnated with a polyurethane.

2. The method of claim 1, wherein the fabric has a mesh width of $<0.25\lambda$, $\lambda$ being the wavelength of the radiation to be screened off at the upper frequency limit.

3. The method of claim 2, wherein the fabric has a mesh width of $<0.1\lambda$.

4. The method of claim 1, wherein the metal is selected from the group consisting of nickel, gold, cobalt, copper and combinations thereof.

5. The method of claim 1, wherein the metal is nickel.

6. The method of claim 1, wherein the thickness of the metal layer deposited on the individual filament amounts to from 0.1 to 1.0 $\mu$m.

7. A method according to claim 1, wherein the fabric is a knitted net fabric.

8. A method according to claim 1, wherein the polyurethane contains carbon black.

9. A method according to claim 1, wherein the fabric has a percentage of free openings therein of from 80% to 95%.

10. A method according to claim 1, wherein the fabric is a tulle fabric.

11. A method according to claim 1, wherein the fabric is a warp knitted fabric.

12. A method according to claim 1, wherein the fabric is a polyamide.

13. A method according to claim 1, wherein the fabric is a polyester.

* * * * *